US005815922A

United States Patent [19]

Sato

[11] Patent Number: 5,815,922

[45] Date of Patent: Oct. 6, 1998

[54] METHOD AND APPARATUS FOR FORGING HELICAL RING GEAR

[75] Inventor: Hideyuki Sato, Obu, Japan

[73] Assignee: Denso Corporation, Kariya, Japan

[21] Appl. No.: 925,989

[22] Filed: Sep. 9, 1997

[30] Foreign Application Priority Data

Sep. 17, 1996 [JP] Japan ..... 8-244757

[51] Int. Cl.[6] ..... B21D 45/02; B21D 28/00; C21C 3/00

[52] U.S. Cl. ..... 29/893.34; 72/344; 74/438; 74/458

[58] Field of Search ..... 29/893.34; 72/344, 72/345, 359; 74/438, 458

[56] References Cited

FOREIGN PATENT DOCUMENTS

A-57-134230 8/1982 Japan .
A-1-150427 6/1989 Japan .

*Primary Examiner*—P. W. Echols

*Attorney, Agent, or Firm*—Harness, Dickey & Pierce, PLC

[57] ABSTRACT

An apparatus for forging a ring gear having inner and outer helical gears formed with a predetermined phase relation therebetween is described. The apparatus is composed of a fixed outer die, a movable inner die, a mandrel carrying the inner die on its top and a knockout cylinder for ejecting a ring gear from dies after the forging process is completed. A material to be forged is charged in a space defined between the outer and inner dies and forged into the helical ring gear. The forged ring gear is first ejected from the outer die by pushing up the knockout cylinder and the mandrel while rotating the mandrel according to a lead of the helical gear of the outer die. Then, the forged ring gear is ejected from the inner die by further pushing up the knockout cylinder while rotating the knockout cylinder according to a lead of the helical gear of the inner die. In this manner the helical ring gear can be ejected smoothly from both outer and inner dies. Since the mandrel, on which the inner gear is fixed, is engaged with the stationary structure by a helical gear which is formed with the same phase as the helical gear of the outer die, the inner and outer helical gears formed on the ring gear can be positioned with a predetermined phase relation therebetween.

5 Claims, 5 Drawing Sheets

METHOD AND APPARATUS FOR FORGING HELICAL RING GEAR

CROSS-REFERENCE TO RELATED APPLICATION

This application is based upon and claims benefit of priority of Japanese Patent Application No. Hei-8-244757 filed on Sep. 17, 1996, the content of which is incorporated herein by reference.

BACKGROUND OF THE INVENTION

1. Field of the Invention

The present invention relates to an apparatus for forging a ring gear having helical gears formed both on inner and outer surfaces thereof with a predetermined phase difference therebetween.

2. Description of Related Art

An apparatus for forging a helical ring gear having gear teeth formed on both surfaces thereof is disclosed in JP-A-1-150427. The apparatus has a fixed outer die with teeth formed inside and a movable inner die with teeth formed outside. The inner die is mounted in the apparatus so that it can rotate and slide in the axial direction. A material to be forged is inserted in a space between the outer and inner dies. A knockout device for ejecting a forged part from the dies is mounted in the apparatus so that it can slide axially. The forged part is ejected from the outer die together with the inner die by an upward motion of the knockout device while the forged part is rotated along the helical gear teeth by the upward motion. After the forged part is ejected from the outer die together with the inner die, further upward movement of the inner die is prevented and only the forged part is further pushed up by the knockout device.

The forging apparatus described in JP-A-89-150427 has no means to restrict a rotational angle of the inner die relative to the fixed outer die during a forging process. Therefore, relative positions of inner and outer gear teeth become arbitrary. In other words, it is not possible to forge a ring gear having a predetermined phase relation between the inner and outer gears.

SUMMARY OF THE INVENTION

The present invention has been made in view of the above-mentioned problem, and an object of the present invention is to provide an apparatus for forging a helical ring gear with precision which has a predetermined phase relation between inner and outer helical gears. Another object of the present invention is to provide a method of forging a helical ring gear having helical gears formed both inside and outside thereof, in which a forged helical ring gear is easily and smoothly ejected from forging dies after a forging process is completed.

According to the present invention, the forging apparatus is composed of a ring-shaped outer die immovably mounted on a stationary structure of the apparatus, a disc-shaped inner die disposed inside of the outer die coaxially therewith and mounted on a mandrel which is movable axially and rotatable, an axially movable punch for forging a material into the helical ring gear, and a knockout cylinder for ejecting the forged helical ring gear from the outer and inner dies. A material to be forged is placed in a forging space defined between the outer and inner dies and pressed and forged by the axially movable punch.

After the forging process is completed, the forged helical ring gear is pushed up by the knockout cylinder to separate and eject the same from the outer die. Since a helical gear is formed outside of the ring gear, the ring gear has to be rotated to follow a lead of the helical gear while being pushed up in order to separate and eject it from the outer die. For rotating the mandrel, a helical gear engaging with the stationary structure of the apparatus is provided at an end of the mandrel opposite to the other end where the inner die is fixedly mounted thereon. The helical gear formed on the mandrel has the same phase as that of the helical gear formed inside of the outer gear, so that the forged helical ring gear is rotated according to the lead of the helical gear of the outer die when the forged helical ring gear is pushed up by the knockout cylinder. Thus, the forged helical ring gear is smoothly ejected from the outer die. Further, the helical gear formed on the mandrel and the helical gear of the inner die fixed on the top end of the mandrel are arranged to have a predetermined positional relation, so that both inside and outside helical gears formed on the forged ring gear are positioned with a predetermined phase relation.

The forged helical ring gear is further ejected from the inner die after it is ejected from the outer die. The helical ring gear is further pushed up by the knockout cylinder while the mandrel is held immovable by a stopper. The helical ring gear has to be rotated in addition to the upward movement to be ejected from the inner gear since the inner helical gear is formed on the ring gear and it is in engagement with the helical gear of the inner die. Since the knockout cylinder according to the present invention is supported on the stationary structure of the apparatus by means of bearings, it can be rotated according to the lead of the helical gear of the inner die. Thus, the forged helical ring gear is smoothly ejected from the inner gear. An axial load imposed on the knockout cylinder during the forging process is totally received by the stationary structure of the apparatus, thereby the bearings being protected.

Other objects and features of the present invention will become more readily apparent from a better understanding of the preferred embodiment described below with reference to the following drawings.

DETAILED DESCRIPTION OF THE PREFERRED EMBODIMENT

Figure 1:
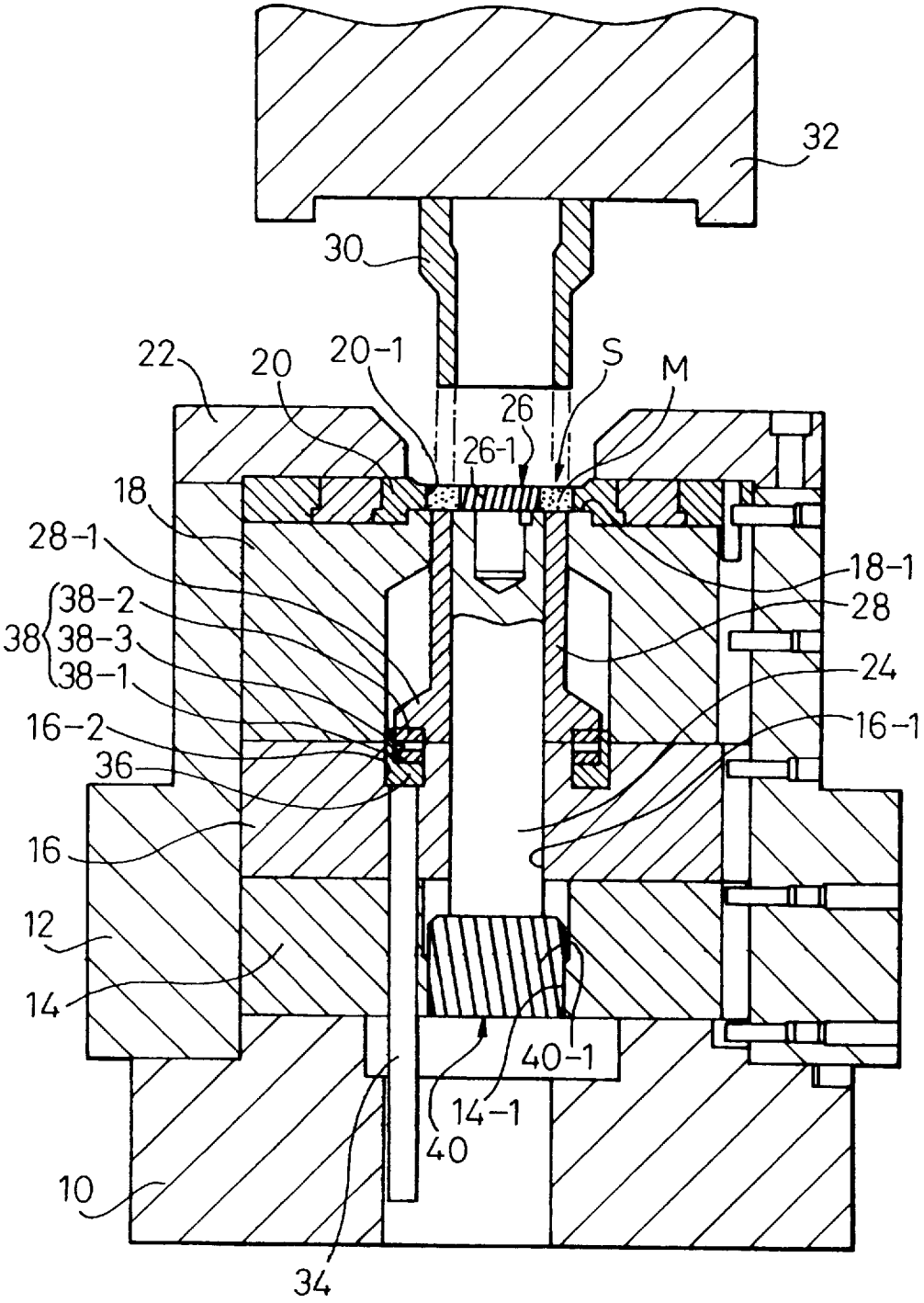
FIG. 1 is a cross-sectional view showing a forging apparatus according to the present invention.

Referring to FIG. 1, the structure of the forging apparatus according to the present invention will be described. A cylindrical holder 12 is fixed to the base 10, and a ring-shaped lower spacer 14, a ring-shaped upper spacer 16 and die holder 18 are disposed in an inside bore of the cylindrical holder 12 in this order from the bottom. A ring-shaped outer die 20 is placed on the die holder 18 and fixed thereto by an upper plate 22. A helical gear 20-1 for forming a helical gear on an outer periphery of a ring gear M is formed on an inside bore of the outer die 20. A mandrel 24 is disposed slidably and rotatably in an inner bore of the upper spacer 16, and the inner die 26 is fixedly mounted on the upper end of the mandrel 24. A helical gear 26-1 for forming a helical gear on an inner bore of the ring gear M is formed on an outer periphery of the inner die 26. A knockout cylinder 28 is slidably and rotatably mounted outside of the mandrel 24. The upper end of the knockout cylinder 28 sticks out a little from an upper surface 18-1 of the die holder 18. When forging force is applied to the ring gear M, the upper end of the knockout cylinder 28 is pressed down to a level of the upper surface 18-1, being deformed elastically by the forging force. An annular space S for receiving a material to be forged is formed by the die holder 18, the outer die 20, the inner die 26 and the upper end of the knockout cylinder 28. A punch 30 connected to a ram 32 is located above the forging dies and driven downward by the ram 32 to apply the forging force.

A flange 28-1 formed at the bottom end of the knockout cylinder 28 which is for ejecting the forged ring gear from the dies is located in contact with the upper surface of the upper spacer 16 during a forging process. Plural knockout pins 34 (only one pin is shown in the cross-sectional drawing) which push up the knockout cylinder 28 to eject the ring gear are slidably mounted in the lower and upper spacers 14 and 16. An L-shaped pushup plate 36 is located in an annular recess 16-2 formed on the upper surface of the upper spacer 16, and the upper end of the knockout pin 34 is made in contact with the L-shaped pushup plate 36. A plurality of bearings 38, each composed of a lower ring 38-1, a roller 38-3 and an upper ring 38-2, are disposed between the flange 28-1 of the knockout cylinder 28 and the L-shaped pushup plate 36. The knockout cylinder 28 is pushed up, for ejecting the forged ring gear from the dies, by the knockout pins 34 via the bearings 38.

At the bottom end of the mandrel 24, there is formed an engaging portion 40 having a helical gear 40-1 which engages with another helical gear 14-1 formed on the inner bore of the lower spacer 14. The helical gears 40-1 and 14-1 are formed with the same phase as the helical gear 20-1 of the outer die 20.

Figure 2:
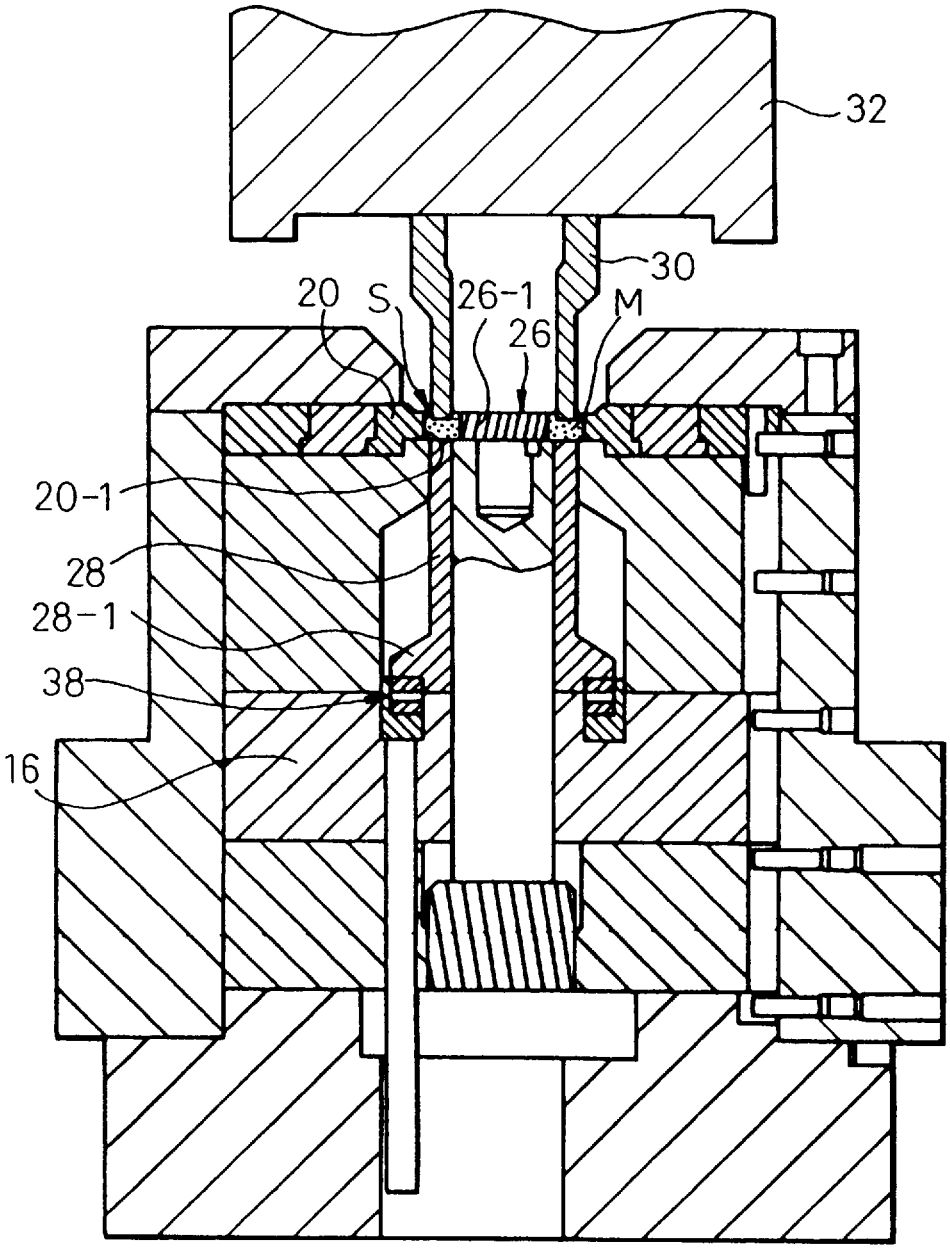
FIG. 2 is a cross-sectional view showing the forging apparatus shown in FIG. 1 which is in a forging process.

Now, the forging process and the ejecting process in the forging apparatus will be described, referring to FIGS. 2–5. The material to be forged is put into the annular space S. Then, the punch 30 is lowered by the ram 32 to apply a forging force to the material within the annular space S, as shown in FIG. 2. The material is pressed in the closed and limited space S and forged into a ring gear M which has an outer gear corresponding to the helical gear 20-1 of the outer die 20 and an inner gear corresponding to the helical gear 26-1 of the inner gear 26. Since the bottom surface of the flange 28-1 of the knockout cylinder 28 directly contacts the upper surface of the upper spacer 16 and all the forging force applied to the knockout cylinder 28 during the forging process is received by the upper spacer 16, no additional load is applied to the bearings 38. The bearings 38 are thus protected from high load during the forging process.

Figure 3:
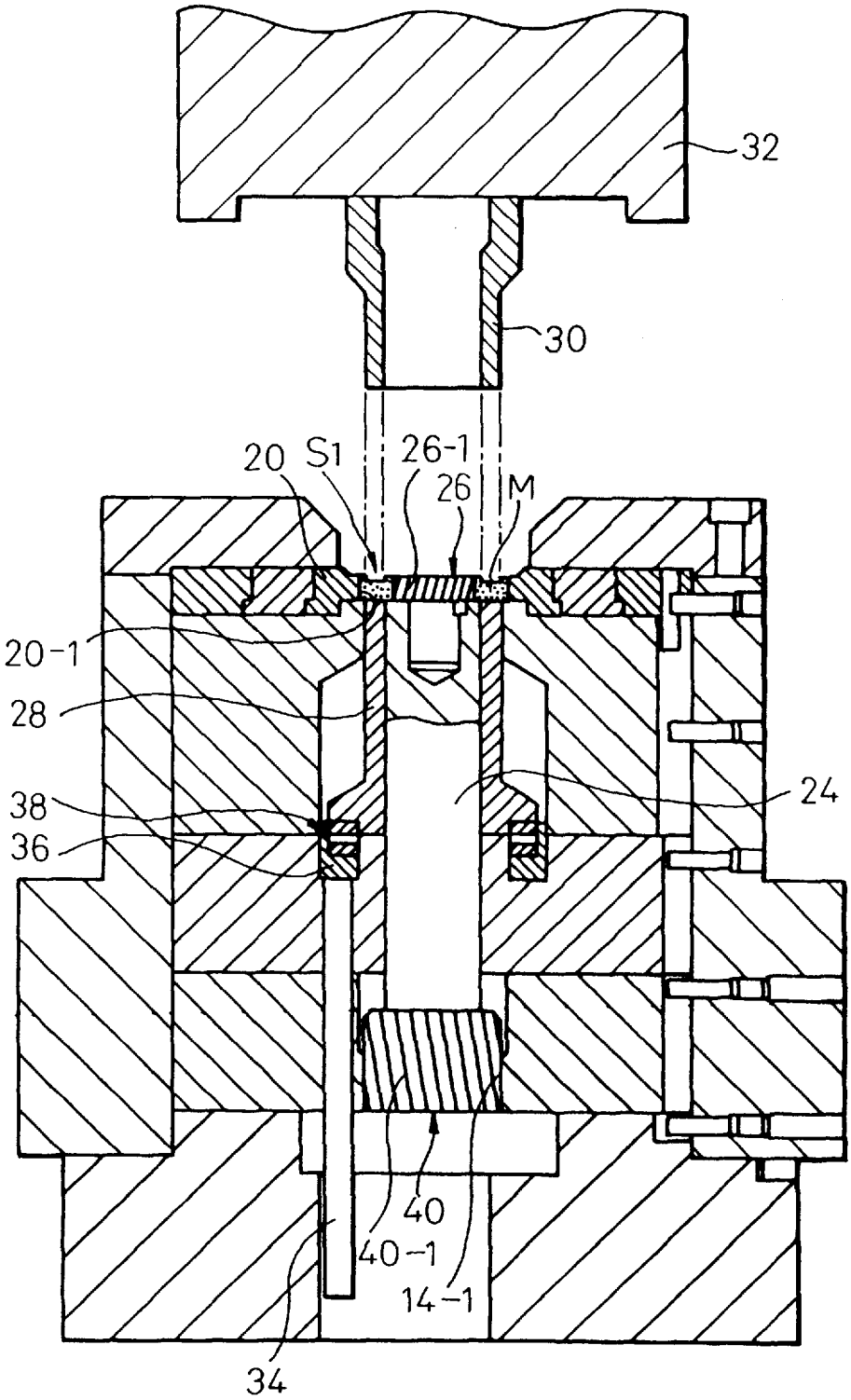
FIG. 3 is a cross-sectional view showing the forging apparatus shown in FIG. 1 which is in a state after the forging process has been completed and a ram holding a punch has been lifted.
Figure 4:
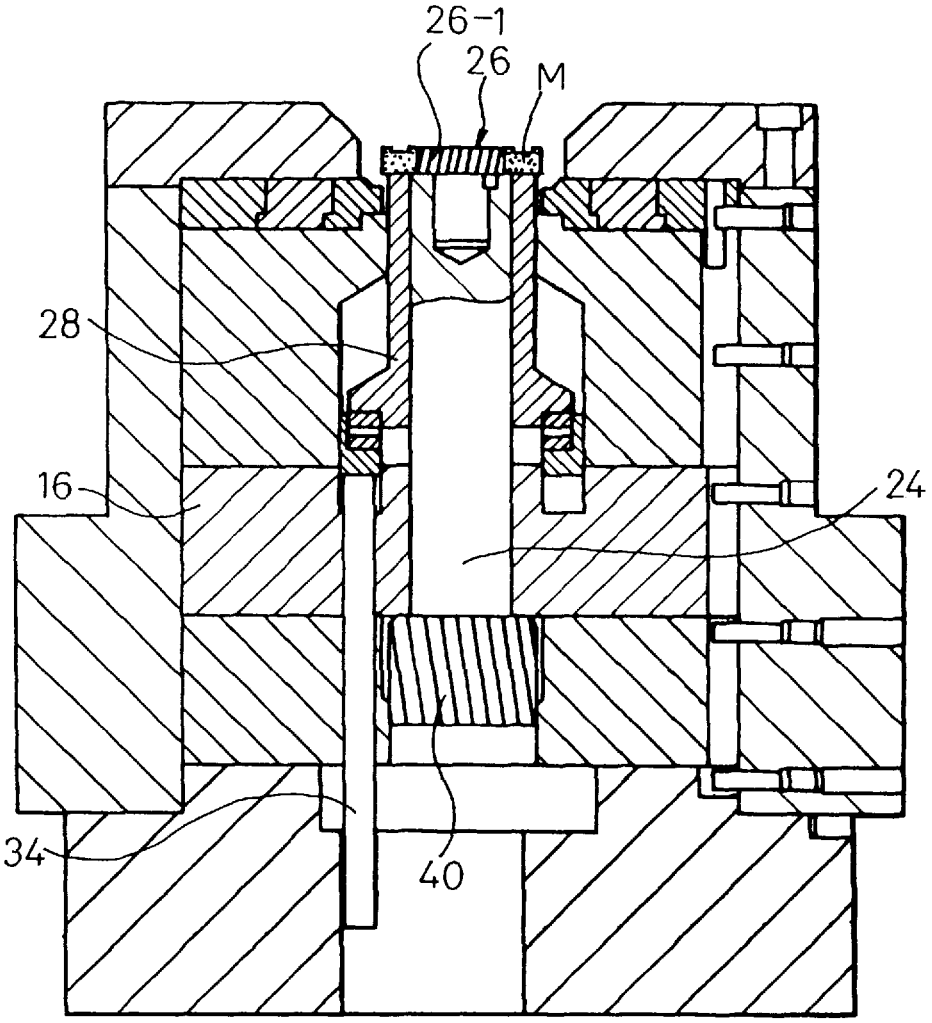
FIG. 4 is a cross-sectional view showing the forging apparatus, an upper ram holding a punch omitted, which is in a state where a forged ring gear has been ejected from an outer die.

After the ring gear is forged, the punch 30 held by the ram 32 is lifted upward, and the ring gear M is left in the dies as shown in FIG. 3. Then, the forged ring gear M is pushed up by the knockout cylinder 28 which is thrust upward by the knockout pins 34 via the L-shaped pushup plate 36 and bearings 38, as shown in FIG. 4. The knockout pins 34 are driven upward by a mechanism not shown in the drawing. The ring gear M is pushed up together with the inner die 26 and the mandrel 24. The ring gear M cannot be ejected from the outer die 20 if it is not rotated, because the helical gear formed outside of the ring gear M engages with the helical gear 20-1 of the outer die 20. To eject the ring gear M from the outer die 20, it must be rotated while it is pushed up. As the engaging portion 40 of the mandrel 24 engages with the lower spacer 14 through the respective helical gears 40-1 and 14-1, the mandrel 24 is rotated while moving upward. Because the helical gear 40-1 of the mandrel 24 and the helical gear 20-1 of the outer die 20 are made with the same phase, the ring gear M is smoothly rotated along the helical gear 20-1 of the outer die 20 while it is moving up, and ejected smoothly from the outer die 20 without any harmful force applied to the ring gear M. The upward and rotational movements of the mandrel 24 stop at the point where an upper shoulder of the engaging portion 40 abuts the bottom surface of the upper spacer 16, as shown in FIG. 4.

Figure 5:
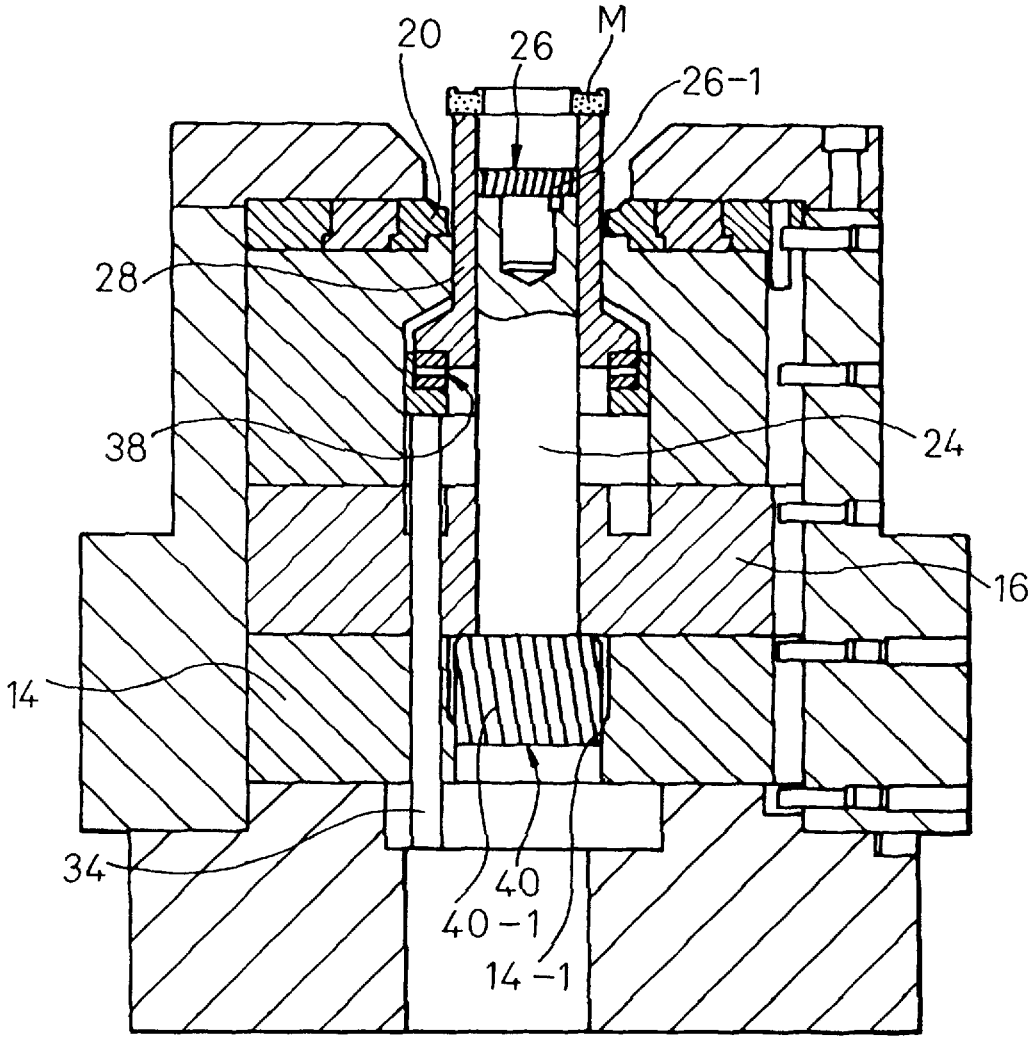
FIG. 5 is a cross-sectional view showing the forging apparatus, the upper ram holding the punch omitted, which is in a state where the forged ring gear has been separated from an inner die.

After the motion of the mandrel 24 has been stopped at the position shown in FIG. 4, the knockout cylinder 28 continues to move upward as shown in FIG. 5. During this upward movement of the knockout cylinder 28, the inner die 26 which is fixed to the mandrel 24 is kept immovable, while the forged ring gear M is rotated together with the knockout cylinder 28 by the helical gear 26-1 of the inner die 26 engaging with the inner helical gear of the ring gear M. The knockout cylinder 28 can be rotated smoothly because it is supported by bearings 38 on the L-shaped pushup plate 36. Thus, the ring gear M is ejected from the inner die 26.

The ring gear M is dismounted from the knockout cylinder 28. Then, the knockout cylinder 28 is lowered to the original position shown in FIG. 1 together with the knockout pins 34. The mandrel 24 carrying the inner die 26 thereon is also lowered to the original position, being accompanied by its rotational motion caused by the helical gear 40-1 of the engaging portion 40 which engages with the helical gear 14-1 formed on the lower spacer 14. Thus, all the components of the forging apparatus are returned to their original position shown in FIG. 1, and the forging process is repeated.

While the present invention has been shown and described with reference to the foregoing preferred embodiment, it will be apparent to those skilled in the art that changes in form and detail may be made therein without departing from the scope of the invention as defined in the appended claims.

What is claimed is:

1. An apparatus for forging a helical ring gear comprising:

a ring-shaped outer die having a helical gear formed inside thereof, immovably fixed to a stationary structure of the forging apparatus;

a disc-shaped inner die having a helical gear formed on an outer periphery thereof, placed inside of the outer die coaxially therewith, forming an annular forging space between the outer and inner dies into which a material to be forged is inserted;

a punch for pressing and forging the material in the annular space into the helical ring gear;

a knockout cylinder for ejecting the forged helical ring gear from the outer and inner dies, which is movable axially and is supported rotatably on the stationary structure of the apparatus, so that the knockout cylinder can be rotated by the helical gear of the inner die when the forged ring gear is ejected from the inner die; and means for carrying the inner die fixed thereon, slidably and rotatably mounted inside of the knockout cylinder, so that the carrying means can be rotated with the same phase as the forged helical ring gear rotated along the helical gear of the outer die when the forged helical ring gear is ejected from the outer die.

2. An apparatus for forging a helical ring gear according to claim 1, wherein the inner die carrying means is a mandrel having an upper end on which the inner die is fixed and an engaging portion at its bottom end which engages with the stationary structure of the forging apparatus by means of a helical gear formed on the engaging portion, the helical gear on the engaging portion having the same phase as that of the helical gear formed inside of the outer die.

3. An apparatus for forging a helical ring gear according to claim 1, wherein the knockout cylinder is rotatably supported on the stationary structure of the forging apparatus by means of bearings.

4. An apparatus for forging a helical ring gear according to claim 3, wherein an axial force imposed on the knockout cylinder during a forging process is directly received by the stationary structure of the forging apparatus without being received by the bearings.

5. A method of forging a helical ring gear in a forging apparatus having a ring-shaped outer die, a disc-shaped inner die disposed inside of the outer die coaxially therewith to form an annular forging space between two dies, a punch for applying a forging force to a material inserted in the space, knockout cylinder for ejecting the forged helical ring gear from the dies, and a mandrel for ejecting the forged helical ring gear from the outer die, the method comprising steps of:

charging a material to be forged in the annular forging space;

forging the material into the helical ring gear having helical gears formed inside and outside thereof;

ejecting the forged helical ring gear from the outer die by an upward thrust of the mandrel and the knockout cylinder while rotating the mandrel according to a lead of the helical gear formed on the outside of the helical ring gear;

ejecting further the forged helical ring gear from the inner die by an upward thrust of the knockout cylinder while rotating the knockout cylinder according to a lead of the helical gear formed on the inside of the helical ring gear; and dismounting the helical ring gear from the forging apparatus.

* * * * *